US011933547B2

(12) United States Patent
Nielsen et al.

(10) Patent No.: US 11,933,547 B2
(45) Date of Patent: Mar. 19, 2024

(54) DOUBLE PLATE HEAT EXCHANGER

(71) Applicant: Danfoss A/S, Nordborg (DK)

(72) Inventors: Helge Nielsen, Sydals (DK); Martin Debevc, Kozina (SI)

(73) Assignee: Danfoss A/S, Nordborg (DK)

( * ) Notice: Subject to any disclaimer, the term of this patent is extended or adjusted under 35 U.S.C. 154(b) by 26 days.

(21) Appl. No.: 17/831,679

(22) Filed: Jun. 3, 2022

(65) Prior Publication Data

US 2022/0397349 A1 Dec. 15, 2022

(30) Foreign Application Priority Data

Jun. 9, 2021 (DK) ..... PA202100611

(51) Int. Cl.
*F28D 9/00* (2006.01)
*F28F 3/08* (2006.01)

(52) U.S. Cl.
CPC ..... *F28D 9/005* (2013.01); *F28F 3/086* (2013.01); *F28F 2265/16* (2013.01)

(58) Field of Classification Search
CPC ..... F28D 9/005; F28F 3/086; F28F 2265/16
USPC ..... 165/167
See application file for complete search history.

(56) References Cited

U.S. PATENT DOCUMENTS 2,248,933 A * 7/1941 Astle ..... F28D 9/0093 165/76
4,347,897 A * 9/1982 Sumitomo ..... F28F 13/02 165/DIG. 360
5,435,383 A * 7/1995 Rajagopal ..... F28F 3/10 165/166

(Continued)

FOREIGN PATENT DOCUMENTS

EP 0 832 409 B1 2/2001
EP 1 811 255 A2 7/2007

(Continued)

OTHER PUBLICATIONS

Extended European Search Report corresponding to European Patent Application No. 22178064.6 dated Oct. 21, 2022.

*Primary Examiner* — Justin M Jonaitis

(74) *Attorney, Agent, or Firm* — McCormick, Paulding & Huber PLLC

(57) ABSTRACT

A plate heat exchanger (1) includes a stack of plate elements (2), each plate element (2) being of a double wall construction having a first heat transfer plate (10) and a second heat transfer plate (20), each having a central heat exchanging portion (40) provided with surface patterns (45) adapted for a surface pattern (45) of first heat transfer plate (10) of one plate element (2) to contact a surface pattern (45) of a second heat transfer plate (20) of a neighbouring plate element (2) forming a first flow path (A) for a first fluid at the one side and second flow path for a second fluid (B) at the second side of a plate element (2), where the plate elements (2) are formed with openings (3*a*, 3*b*, 3*c*, 3*d*) in opening areas (30*a*, 30*b*, 30*c*, 30*d*), wherein a first heat transfer plate (10) in an opening area (30*a*, 30*b*, 30*c*, 30*d*) is formed with a closed projection (50) projecting in a first direction, and in the same opening area (30*a*, 30*b*, 30*c*, 30*d*) is formed with an open projection (65) formed on a second direction being opposite to the first direction, such that the closed (50) and open (65) projections together defines a first leak cavity (70).

11 Claims, 4 Drawing Sheets

(56) References Cited

U.S. PATENT DOCUMENTS

| | | | | | |
|---|---|---|---|---|---|
| 5,443,115 | A * | 8/1995 | Pedersen | F28F 3/083 | 165/70 |
| 5,924,484 | A * | 7/1999 | Andersson | F28D 9/005 | 165/178 |
| 5,971,065 | A * | 10/1999 | Bertilson | F28F 3/083 | 165/166 |
| 6,230,794 | B1 * | 5/2001 | Bertilsson | F28D 9/005 | 29/890.039 |
| 8,646,517 | B2 * | 2/2014 | Blomgren | F28F 3/083 | 165/167 |
| 9,400,142 | B2 * | 7/2016 | Holm | F28D 9/005 | |
| 2012/0267084 | A1 * | 10/2012 | Crawford | F28F 3/005 | 165/170 |

FOREIGN PATENT DOCUMENTS

| | | | |
|---|---|---|---|
| EP | 3 745 072 | A1 | 12/2020 |
| JP | 2002-107089 | A | 4/2002 |
| WO | 2012/148972 | A1 | 11/2012 |

* cited by examiner

DOUBLE PLATE HEAT EXCHANGER

CROSS-REFERENCE TO RELATED APPLICATION

This application claims foreign priority benefits under U.S.C. § 119 from Danish Patent Application No. PA202100611 filed Jun. 9, 2021, the content of which is hereby incorporated by reference in its entirety.

TECHNICAL FIELD

The present invention relates to plate heat exchangers of the kind having double plates. More specifically the present invention relates to double plate heat exchangers in which a leak may be detected easier than in similar prior art double plate heat exchangers.

BACKGROUND

A plate heat exchanger exchanges heat between two or more fluids. In most plate heat exchangers, a number of stacked plate elements separate the fluids, each plate element having a central heat transferring part and a surrounding edge part. Sometimes particular care must be taken to avoid one heat exchanging fluid from leaking into the flow way of another heat exchanging fluid. This is, e.g., the case in heat exchangers which are used for heating or cooling potable fluids using non-potable fluids, in heat exchangers used for processing critical fluids, and in heat exchangers in which mixing of the two fluids would result in undesired chemical reactions. In these cases, a heat exchanger of the double wall type is normally used. In double wall heat exchangers, the plate elements separating the heat exchanging fluids each comprises two plates which are joined together. For brazed heat exchanger brazing of some areas must be avoided.

In order to be able to detect a leak in one of the plates, the plates are often joined together in such a manner that leaking fluid is allowed to flow between the plates towards the edge portion of the plate element, e.g. to a location where it can be detected. Fast detection of a leak requires that the plates are arranged with a sufficient spacing to allow leaking fluid to flow easily towards the detecting position. On the other hand, in order to provide sufficient efficiency in heat transfer between the heat exchanging fluids, it is desirable to arrange the plates as close to each other as possible. Accordingly, various attempts have previously been done to design double wall heat exchangers taking these two requirements into consideration.

SUMMARY

The object of the invention is solved according to the features given in the claims.

This includes introducing a plate heat exchanger comprising a stack of plate elements each plate element being of a double wall construction comprising a first heat transfer plate and a second heat transfer plate each comprising a central heat exchanging portion provided with surface patterns adapted for a surface pattern of first heat transfer plate of one plate element to contact a surface pattern of a second heat transfer plate of a neighbouring plate element forming a first flow path (A) for a first fluid at the one side and second flow path for a second fluid (B) at the second side of a plate element, where the plate elements are formed with openings in opening areas, wherein that a first heat transfer plate in an opening area is formed with a closed projection projecting in a first direction, and in the same opening area is formed with an open projection formed on a second direction being opposite to the first direction, such that the closed and open projections together defines a first leak cavity.

The open projection may be adapted to allow fluid to pass between the respective opening and the respective flow path (A, B) when connected to open projections of a neighbouring plate element, and where the closed projection is adapted to close for fluid and seal the respective opening from the respective flow path.

A plural of open projections may be positioned around the full circumference of the respective opening, and a single closed projection may circumference the respective opening.

A first fixation and a second fixation may be positioned at opposite sides of the relative opening fixing the first and second heat transfer plates of the plate element together.

The closed projection may be connected to a drain channel formed to connect the closed projection fluidically to the outside of the heat exchanger. The drain channel may be formed as a projection formed in the same first direction as the projection.

A recess may be formed in the closed projection, and where the recess projects at in a second direction being opposite to the closed projection and into the first leak cavity.

The closed projection may be connected to a closed projection of a heat transfer plate of a connected neighbouring plate element, the recess defines a second leak cavity.

The second leak cavity may be positioned between respectively a third fixation and a fourth fixation of the heat transfer plate to a heat transfer plate of a neighbouring plate element.

An opening may be formed in the shared plate wall of the closed projections and recess forming fluid communication between the first and second leak cavities.

DETAILED DESCRIPTION

It should be understood, that the detailed description and specific examples, while indicating embodiments of the invention, are given by way of illustration only, since various changes and modifications will become apparent to those skilled in the art from the detailed description.

Figure 1:
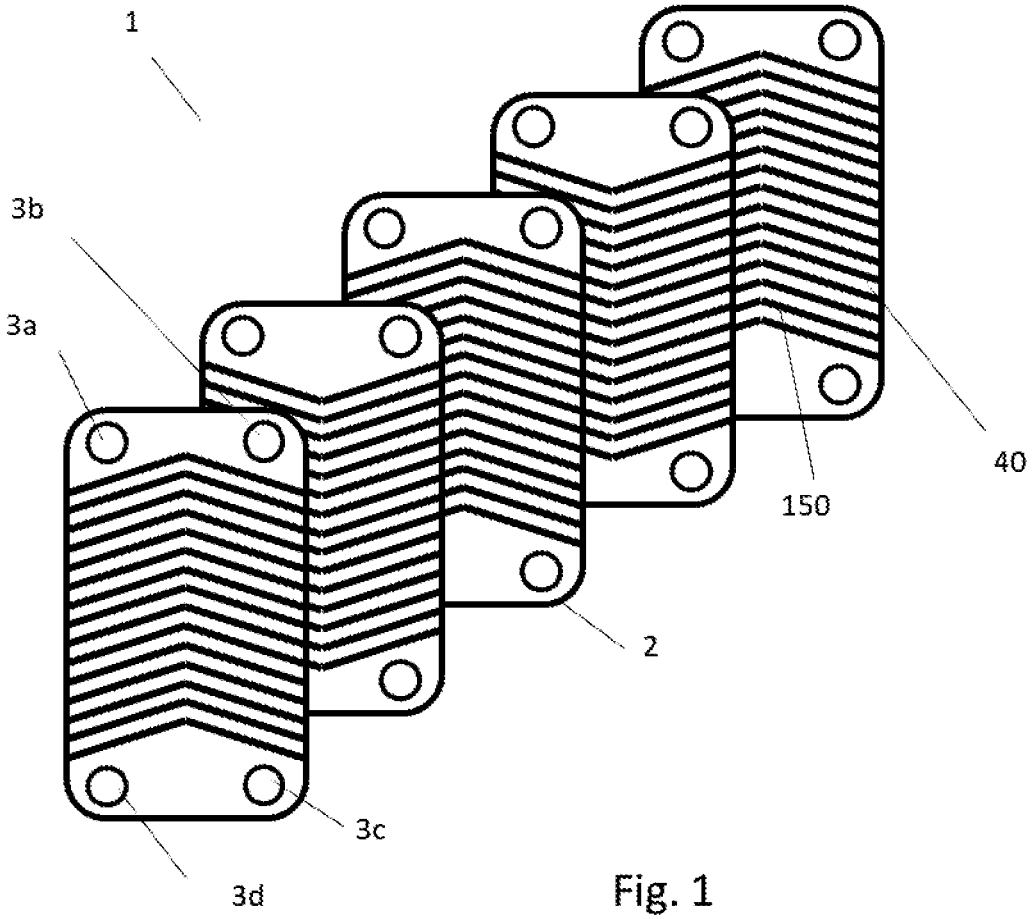
FIG. 1 General illustration of the principle of a plate kind heat exchanger.
Figure 2:
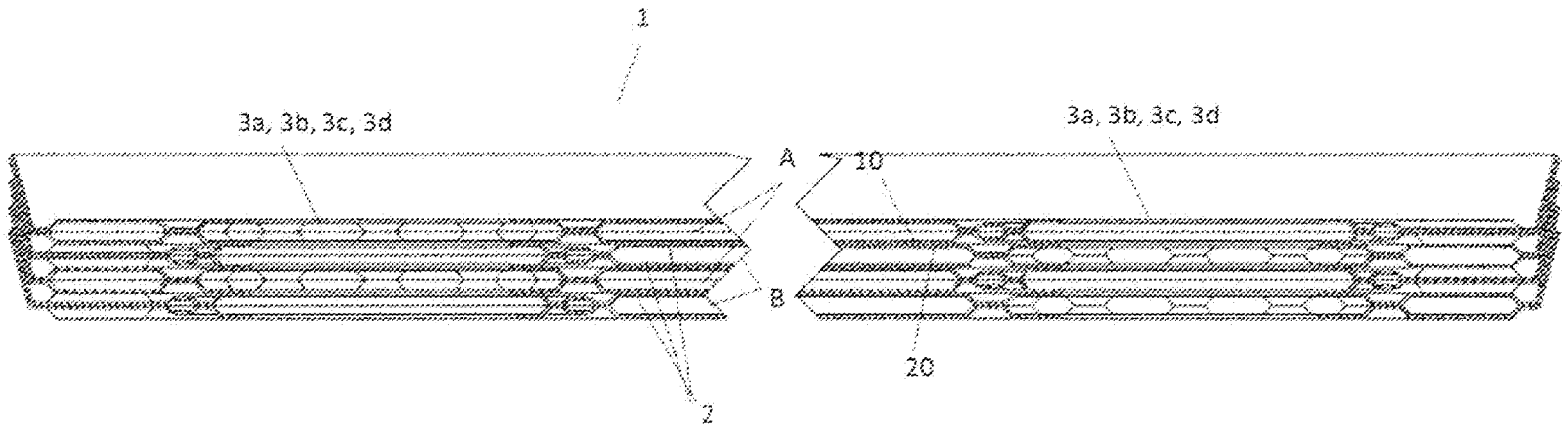
FIG. 2 Side view of an embodiment double plate heat exchanger according to the invention.

FIGS. 1 and 2 illustrate a heat exchanger (1) formed of plate elements (2) connected to neighbouring plate elements (2). Each plate element (2) is formed with openings (3*a*, 3*b*, 3*c*, 3*b*) and a heat exchanging portion (40) with surface patterns (45). When stacked, the connected surface patterns (45) of neighbouring plate elements (2) forms flow paths (A, B) at the respective opposite surfaces of the plate elements (2). Further, the openings (3*a*, 3*b*, 3*c*, 3*b*) are aligned forming respectively a first set of openings (3*a*, 3*d*) defining an inlet and outlet to a first flow path (A), and a second set of openings (3*b*, 3*c*) defining a inlet and outlet (3*b*, 3*c*) to a second flow path (B). The first set of openings (3*a*, 3*d*) and first flow path (A) is sealed from the second set of openings (3*b*, 3*c*) and second flow path (B) allowing to fluids to pass the heat exchanger without the two fluids contacting and mixing. The heat exchanger is adapted for heat to be transferring from the hotter to the colder of the fluids flowing in the flow paths (A, B) over the plate elements (2).

The plate elements (2) is of a double wall construction comprising a first heat transfer plate (10) and a second heat transfer plate (20), each comprising a central heat exchanging portion (40) provided with surface patterns (45). The first (10) and second (20) heat transfer plates are connected over most of their extension, such as at the central heat exchanging portion (40). If one should fail by e.g. forming cracks, the other will ensure the fluids will not leak between the first (A) and second (B) flow paths.

Figure 3:
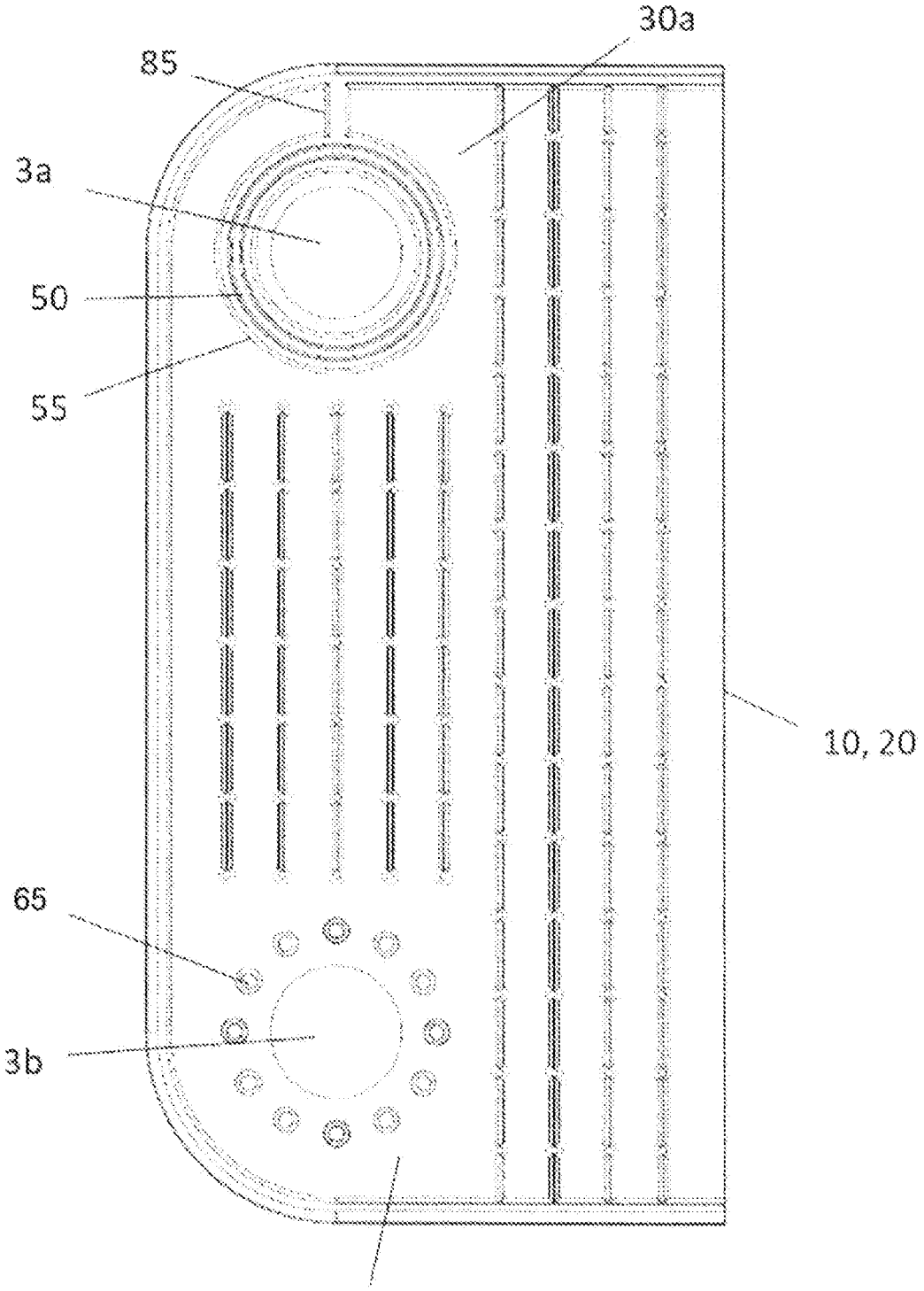
FIG. 3 Top view of a section of a heat transfer plate according to an embodiment of the invention.

FIG. 3 shows an area part of heat transfer plate (10, 20) around two openings (3*a*, 3*b*) formed in opening areas (30*a*, 30*b*). The opening areas (30*a*, 30*b*, 30*c*, 30*d*) in general are formed of essentially flat portions around the openings (3*a*, 3*b*, 3*c*, 3). The figures show a projection (50) formed in at least one opening area (30*a*) projecting in a first direction, possible fully encircling the respectively opening (3*a*).

The projection (50) may have essentially flat top surfaces adapted to contact similar surfaces of neighbouring heat transfer plates (10, 20).

A recess (55) may be formed in the top surface of the projection (50) projecting in a second direction being opposite to the first direction. The recess (55) may be formed at the full circumference of the projection (50).

The projection (50) in the illustrated embodiment is connected to a drain channel 85 formed to connect the projection (50) fluidically to the outside of the heat exchanger (1), such as to its side. In the illustrated embodiment it is formed as a projection or shape in the heat transfer plate (10, 20) in the opening area (30*a*) connecting the projection (50) to the edge of the heat transfer plate (10, 20). The projection or shape forming the drain channel 85 may be formed in the same first direction as the projection (50), but may be lower than this, such that it does not contact any neighbouring plate elements (2).

At least one other opening area (30*b*) may be formed with projections (65) formed at a distance to each other or at least with openings allowing fluid to pass between the respective opening (3*a*, 3*b*, 3*c*, 3*d*) and the respective flow path (A, B). Such projections (65) in the following is referred to as 'open projections' (65) and may be positioned around the full circumference of the respective opening (3*b*).

Figure 4:
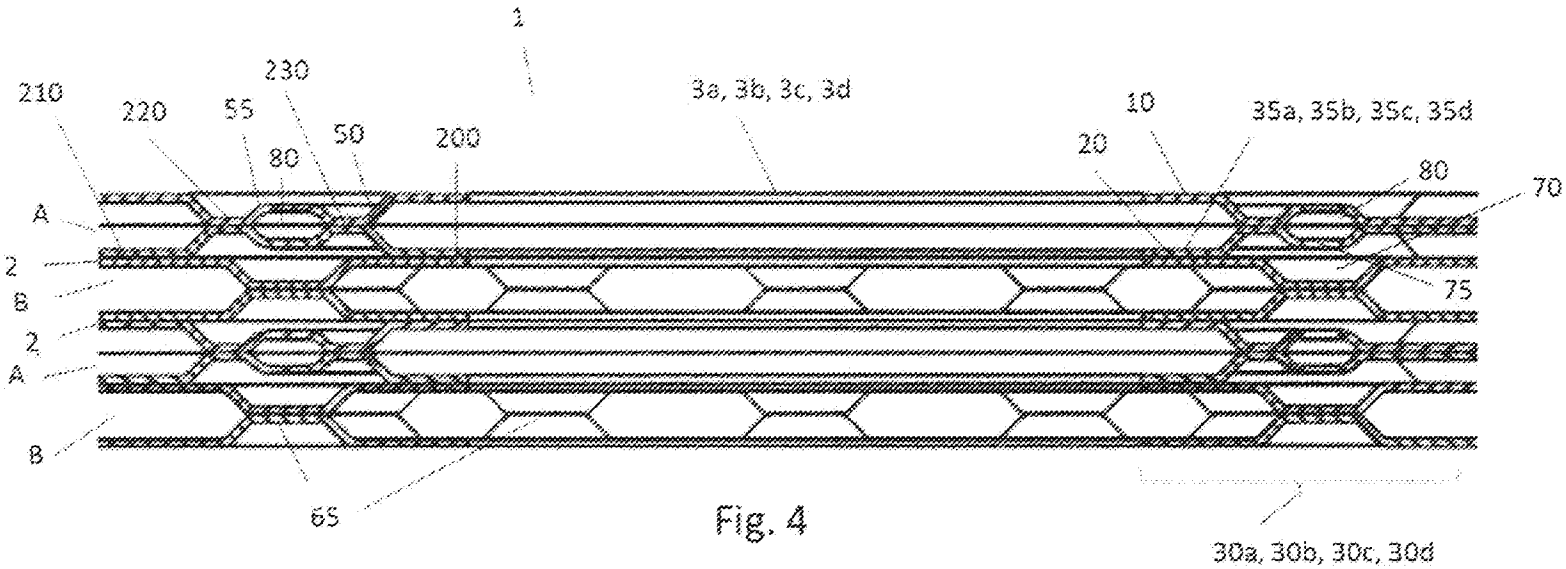
FIG. 4 Side view of a section of the double plate heat exchanger according to the invention.

FIG. 4 illustrates a part section of the heat exchanger (1) of FIG. 2 showing openings (3*a*, 3*b*, 3*c*, 3*d*) of the plural of stacked plate elements (2).

The opening areas (30*a*, 30*b*, 30*c*, 30*d*) may form essentially flat sections which extends parallel to the extension of the respective heat exchanger plate (10, 20). In at least one of the opening areas (30*a*), both the plate element (2) first heat transfer plate (10) and second heat transfer plate (20) in an opening area (30*a*, 30*b*, 30*c*, 30*d*) in the embodiment is formed with a projection (50) projecting in opposite directions relative to each other.

In the illustration the first flow path (A) is sealed from the respective opening (3*a*, 3*b*, 3*c*, 3*d*) by the projection (50) of a heat transfer plate (10, 20) contacting a heat transfer plate (10, 20) of a neighbouring plate element (2), and the projection (50) therefore can be referred to as a 'closed projection' (50). The closed projection (50) may close the flow path at the full circumference of the respective opening (3*a*, 3*b*, 3*c*, 3*d*).

The second flow path (B) in FIG. 4 is open, meaning the respective opening (3*a*, 3*b*, 3*c*, 3*d*) operates as its fluid inlet or outlet.

In the illustrated embodiment both the first (10) and second (20) plates are formed with such closed projections (50) adapted to connect at their top surfaces, the top surfaces thus possibly being flat.

As illustrated, the first (10) and second (20) plate of a plate element (2) in the embodiment is not in contact, but contacts rather a heat transferring plate (10, 20) of a neighbouring plate element (2). This could be such that the first heat transfer plate (10) closed (50) and open (65) projections contacts respectively a corresponding second heat transfer plate (20) closed (50) and open (65) projection. In the same manner the second heat transfer plate (20) closed (50) and open (65) projections contacts respectively a corresponding first heat transfer plate (10) closed (50) and open (65) projection.

The closed projections (50) supports the connected respective neighbouring plate elements (2) in the opening area (30*a*, 30*b*, 30*c*, 30*d*), just as the surface patterns (45) supports in the heat exchanging portions (40). As also indicated previously, they further seals for fluid between the respective opening (3*a*, 3*b*, 3*c*, 3*d*) and the respective flow path (A, B), such as the first flow path (A) as illustrated.

The first (10) and second (20) heat transfer plates of a plate element (2) is connected in the opening areas (30*a*, 30*b*, 30*c*, 30*d*) at both sides of the closed projections (50), just as they are e.g. in the heat exchanging portion (40). At these connections they may be fixed by a first rim fixation (200) and a second fixation (210) at respectively a first and second radial distance relative to the respective opening (3*a*, 3*b*, 3*c*, 3*d*). The fixation may be by welding, brazing, gluing etc.

The first fixation (200) and the second fixation (210) are positioned at opposite sides of the closed projection (50) relative to the opening (3*a*, 3*b*, 3*c*, 3*d*). The first fixation (220) seals towards the fluid inside the opening (3*a*, 3*b*, 3*c*, 3*d*), and second fixation (230) seals between the first (10) and second (20) heat transfer plates of the plate element.

Together the connected first (10) and second (20) heat transfer plates defines a first leak cavity (70) when they are aligned and connected into a plate element (2). If either the first (200) or second (210) fixation fails to seal, the first leak cavity (70) will collect the leaking fluid before mixing with fluids in the other of the flow path (A, B).

The open flow path (B) is ensured by the open projections (65) at the circumference of the opening (3*a*, 3*b*, 3*c*, 3*d*), such as dimples or other shapes.

In the illustrated embodiment both the first (10) and second (20) heat transfer plates are formed with such open projections (65) adapted to connect at their top surfaces where they possibly are flat. In this manner the open projections (65) supports respective plate element (2) in the opening area (30*a*, 30*b*, 30*c*, 30*d*) and at the same time allowing fluid into the respective flow path (A, B), such as the second flow path (B) as illustrated.

In other not illustrated embodiments only one of the first (10) and second (20) heat transfer plates are formed with a closed (50) and/or open (65). In this embodiment they are adapted to contact a possible flat portion of the opening area (30*a*, 30*b*, 30*c*, 30*d*) of a respective heat transfer plate (10, 20) of a neighbouring plate element (2).

FIG. 4 shows the first flow path (A) being sealed from the respective opening (3*a*, 3*b*, 3*c*, 3*d*), and the second flow path (B) being open. The heat exchanger (1) may be formed such that each set of openings (3*a*, 3*d*) connected respectively the first flow path (A) and set of openings (3*b*, 3*c*) comprises a sealed opening area (30*a*, 30*c*) formed with a closed projection (50), and an open opening area (30*b*, 30*d*) formed with open projections (65).

A drain channel (85) in the same manner as respectively the first leak cavity (70) may be formed by a projection or shape formed in the plate material of the first (10) and/or second (20) heat transfer plates projecting to respective the same first and second direction. Either both heat transfer plates (10, 20) are formed with such a projection, and the drain channel (85) thus is formed by the aligned two projections or shape. Alternatively the projection or shape is formed in only one of the heat transfer plates (10, 20), and the drain channel (85) is formed by aligning the projection or shape to the possible flat surface of the other heat transfer plate (10, 20) of the plate element.

The drain channel (85) extend from the first leak cavity (70) to the external edge of the respective heat transfer plate (10, 20), thus being adapted for the leaking fluid within the first leak cavity (70) to be drained to the edge of the heat exchanger (1) and thus to the outside. Here the leakage then can be detected, either visually by seeing the leaking fluid, or possible by including a leakage sensor.

Seen in FIG. 4 is also the recess (55) formed in the projection (50) of at least one of the first (10) or second (20) heat transfer plate, and where the recess (50) projects opposite to the projection (50) and thus into the first leak cavity (70). If the closed projection (50) of the first heat transfer plate (10) projects in the first direction, the recess (55) in the closed projection (50) of the first heat transfer plate (10) thus projects in the second direction opposite to the first direction. Correspondingly, if the closed projection (50) of the second heat transfer plate (20) projects in the second direction, the recess (55) of the second heat transfer plate (20) closed projection (50) thus projects in the first direction. In general, the embodiment shows the first heat transfer plate (10) closed projection (50) formed in the opposite direction to the second heat transfer plate (20) closed projection (50). Correspondingly the recesses (55) of respectively the first (10) and second (20) heat transfer plates are directed opposite to each other.

The recess (55) thus defines a second leak cavity (80) of the plate element (2) positioned between two first leak cavities (70). Where the second leak cavity (80) is formed by two connected plate elements (2), the first leak cavity (70) is formed within the plate element (2) itself.

As described, in the illustrated embodiment both the first heat transfer plate (10) and the second heat transfer plate (20) of the neighbouring plate element (2) are formed with a recess (55) projecting in opposite directions relative to each other, such that they defines a first leak cavity (70) when the first (10) and second (20) heat transfer plates are aligned. Alternatively, only one of the first first transfer plates (10) and connected second heat transfer plate (20) of the neighbouring plate element (2) is formed with a recess (55). Then the second leak cavity (80) is formed when connected to the possible flat top surface of the closed projection (50) of the contacting heat transfer plates (10, 20).

The second leak cavity (80) is positioned between respectively a third fixation (220) and a fourth fixation (230) of the first heat transfer plate (10) to a second heat transfer plate (20) of a neighbouring plate element (2). The third (220) and third (230) fixations may be e.g. by welding, brazing, gluing etc.

The third fixation (220) is at a third radial distance and the fourth fixation (220) is at a fourth radial distance to the opening (3*a*, 3*b*, 3*c*, 3*d*) of said opening areas (30*a*, 30*b*, 30*c*, 30*d*), and the recess (55) is positioned between said third (220) and fourth (230) fixations.

The third fixation (220) seals towards the fluid inside the opening (3*a*, 3*b*, 3*c*, 3*d*), and fourth fixation (230) seals towards the fluid inside the respective first flow path (A, B).

If either the third (220) or fourth (230) fixation fails to seal, the second leak cavity (80) will collect the leaking fluid before mixing with fluids in the other of the flow path (A, B).

The opening (75) may be positioned to connect the first leak cavity (70) and the second leak cavity (80), such as in the recess (55) separating the first (70) and second leak (80) cavities. Leaking fluid collected in the second leak cavity (80) thus will be directed to the first leak cavity (70), and therefrom it flows by the drain channel 85 to the outside of the heat exchanger for detection.

The plate elements (2) may be formed of respectively the first (10) and second (20) heat transfer plates such that when stacked into a heat exchanger (1), then if e.g. the first heat transfer plate (10) is formed with a closed projection (50) in an opening area (30*a*, 30*b*, 30*c*, 30*d*), then this is connected to a closed projection (50) of a second heat transfer plate (20) of the neighbouring plate element (2). In this case the second (20) heat transfer plate in the same opening area (30*a*, 30*b*, 30*c*, 30*d*) is formed with an open projection (65) which is connected to an open projection (65) of a first heat transfer plate (10) of the neighbouring plate element (2) at the opposite side.

Correspondingly, if e.g. the first heat transfer plate (10) is formed with an open projection (65) in an opening area (30*a*, 30*b*, 30*c*, 30*d*), then this is connected to an open projection (65) of a second heat transfer plate (20) of the neighbouring plate element (2). In this case the second (20) heat transfer plate in the same opening area (30*a*, 30*b*, 30*c*, 30*d*) is formed with a closed projection (50) which is connected to a closed projection (50) of a first heat transfer plate (10) of the neighbouring plate element (2) at the opposite side.

While the present disclosure has been illustrated and described with respect to a particular embodiment thereof, it should be appreciated by those of ordinary skill in the art that various modifications to this disclosure may be made without departing from the spirit and scope of the present disclosure.

The invention claimed is:

1. A plate heat exchanger comprising a stack of plate elements each plate element being of a double wall construction comprising a first heat transfer plate and a second heat transfer plate each comprising a central heat exchanging portion provided with surface patterns adapted for contacting a first neighbouring plate element thereby forming a first flow path for a first fluid at the one side and adapted for contacting a second neighbouring plate element thereby forming a second flow path for a second fluid at the second side of the plate element, where the plate elements are formed with openings in opening areas, wherein the first heat transfer plate in an opening area is formed with a closed projection projecting transversely from the plane of the plate element in a first direction, and in the same opening area the second heat transfer plate is formed with an open projection projecting transversely from the plane of the plate element in a second direction being opposite to the first direction, such that the closed and open projections together defines a first leak cavity.

2. The plate heat exchanger according to claim 1, where the open projection projects into a flow path associated with an opening and where the open projection is adapted to allow fluid to pass between the respective opening and the respective flow path when connected to open projections of a neighbouring plate element, and where the closed projection is adapted to close for fluid and seal the respective opening from the respective flow path.

3. The plate heat exchanger according to claim 1, wherein a plural of open projections are positioned around the full circumference of the respective opening, and where a single closed projection circumferences the respective opening.

4. The plate heat exchanger according to claim 1, wherein a first fixation and a second fixation are positioned at opposite sides of the relative opening fixing the first and second heat transfer plates of the plate element together.

5. The plate heat exchanger according to claim 1, wherein the closed projection is connected to a drain channel formed to connect the closed projection fluidically to the outside of the heat exchanger.

6. The plate heat exchanger according to claim 5, wherein the drain channel is formed as a projection formed in the same first direction as the projection.

7. The plate heat exchanger according to claim 1, wherein a recess is formed in the closed projection, and where the recess projects at in a second direction being opposite to the closed projection and into the first leak cavity.

8. The plate heat exchanger according to claim 7, wherein when the closed projection is connected to a closed projection of a heat transfer plate of a connected neighbouring plate element, the recess defines a second leak cavity.

9. The plate heat exchanger according to claim 7, wherein the second leak cavity is positioned between respectively a third fixation and a fourth fixation of the heat transfer plate to a heat transfer plate of a neighbouring plate element.

10. The plate heat exchanger according to claim 7, wherein an opening is formed in the shared plate wall of the closed projections and recess forming fluid communication between the first and second leak cavities.

11. A plate heat exchanger comprising a stack of plate elements each plate element being of a double wall construction comprising a first heat transfer plate and a second heat transfer plate each comprising a central heat exchanging portion provided with surface patterns adapted for a surface pattern of first heat transfer plate of one plate element to contact a surface pattern of a second heat transfer plate of a neighbouring plate element forming a first flow path for a first fluid at the one side and second flow path for a second fluid at the second side of a plate element, where the plate elements are formed with openings in opening areas, wherein a first heat transfer plate in an opening area is formed with a closed projection projecting in a first direction, and in the same opening area is formed with an open projection formed on a second direction being opposite to the first direction, such that the closed and open projections together defines a first leak cavity, where the open projection is adapted to allow fluid to pass between the respective opening and the respective flow path when connected to open projections of a neighbouring plate element, where the closed projection is adapted to close for fluid and seal the respective opening from the respective flow path, and wherein a plural of open projections are positioned around the full circumference of the respective opening, and where a single closed projection circumferences the respective opening.

* * * * *